US007718876B1

(12) United States Patent
Good

(10) Patent No.: US 7,718,876 B1
(45) Date of Patent: May 18, 2010

(54) ANGLED GRAIN DRUM SHELL PLY CONFIGURATION

(75) Inventor: John Good, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 517 days.

(21) Appl. No.: 11/784,700

(22) Filed: Apr. 9, 2007

(51) Int. Cl.
*G10D 13/02* (2006.01)

(52) U.S. Cl. ..... 84/411 R; 428/106

(58) Field of Classification Search ..... 84/411 R; 428/106, 537.1
See application file for complete search history.

(56) References Cited

U.S. PATENT DOCUMENTS 4,012,548 A * 3/1977 Roberti ..... 428/106
5,330,848 A * 7/1994 Kluczynski et al. ..... 428/537.1
5,377,576 A * 1/1995 Good et al. ..... 84/411 R

* cited by examiner

*Primary Examiner*—Jianchun Qin
(74) *Attorney, Agent, or Firm*—William W. Haefliger

(57) ABSTRACT

In a drum shell, the combination comprising the shell having multiple wooden curved plys, each ply having a grain extending in a characteristic direction, the grain direction of at least one ply extending crosswise relation to the grain direction of the next adjacent ply.

13 Claims, 3 Drawing Sheets

FIG. 2.
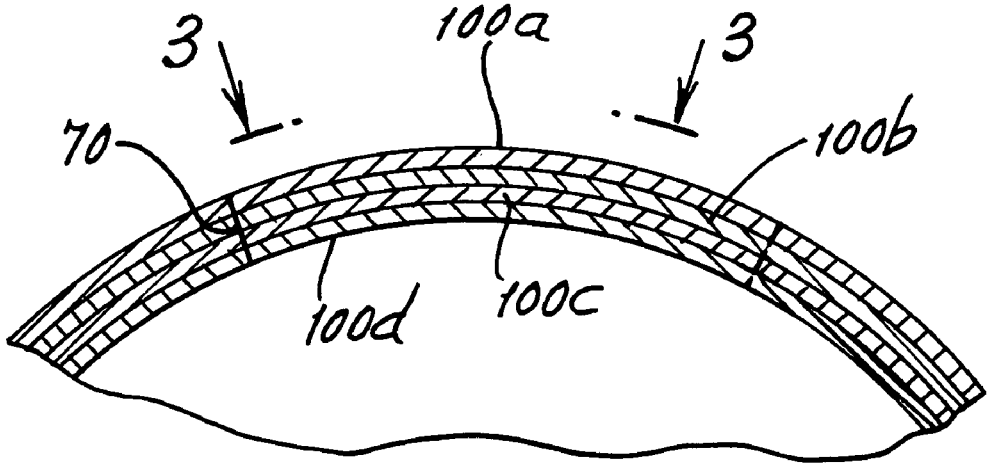
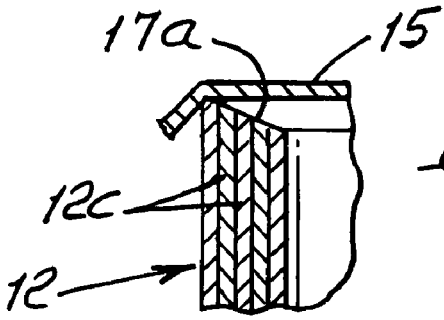
FIG. 1a.
FIG. 3.
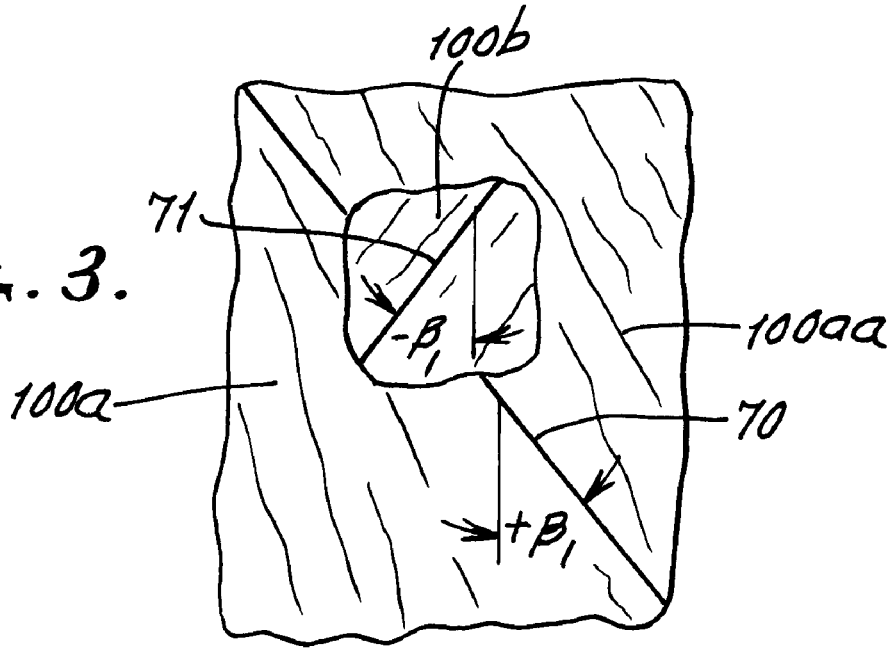

ANGLED GRAIN DRUM SHELL PLY CONFIGURATION

BACKGROUND OF THE INVENTION

This invention relates generally to improvements in acoustic performance of drums, and more specifically to enhancement of production of deeper sounds or tones or pitches from drum.

There is continual need for enhanced performance of drums. Deeper acoustic pitch output from drums is desirable, in this regard.

SUMMARY OF THE INVENTION

It is a major object of the invention to provide improvements in the construction of drum shells to realize deeper pitch outputs from such drums. Basically the improved shell comprises a) multiple wooden curved plys, b) each ply having grain extending in a characteristic direction, c) the grain direction of at least one ply extending crosswise relation to the grain direction of the next adjacent ply about the shell.

As will be seen, the grain direction of the one ply typically extends at an angle $+\alpha_1$ relative to the drum axis, and the grain direction of said next adjacent ply extends at an angle $-\alpha_2$ relative to the drum axis. For example the following grain directional angularities are found to produce desired significantly lowered pitches:

$$30° < +\alpha_1 < 60°$$

$$\text{and } -30° < -\alpha_2 < -60°$$

Preferably and for deeper pitch development, the angularities are as follows:

$$+45° \cong \alpha_1$$

$$-45° \cong -\alpha_1$$

A further object of the invention is to provide said one ply as defining a cut extending at an angle $+\beta_1$ relative to the drum axis, and the adjacent ply defines a cut extending at an angle $-\beta_2$ relative to the drum axis, these cuts extending between upper and lower edges of the plys. Typically, $\alpha_1=\beta_1$ and $-\alpha_2=-\beta_2$ whereby grain directional continuity is maintained at opposite sides of the cuts, and between upper and lower edges of the plies.

A yet further object is to provide cuts through the multiple plys, the cuts substantially angularly equally spaced about an axis defined by the shell.

These and other objects and advantages of the invention, as well as the details of an illustrative embodiment, will be more fully understood from the following specification and drawings, in which:

DRAWING DESCRIPTION

FIG. 1*a* shows a modification;

FIG. 2 is a fragmentary horizontal section taken on lines 2-2 of FIG. 1 through multiple plys or laminations;

FIG. 3 is a fragmentary side view taken in elevation on lines 3-3 of FIG. 2;

DETAILED DESCRIPTION

Figure 1:
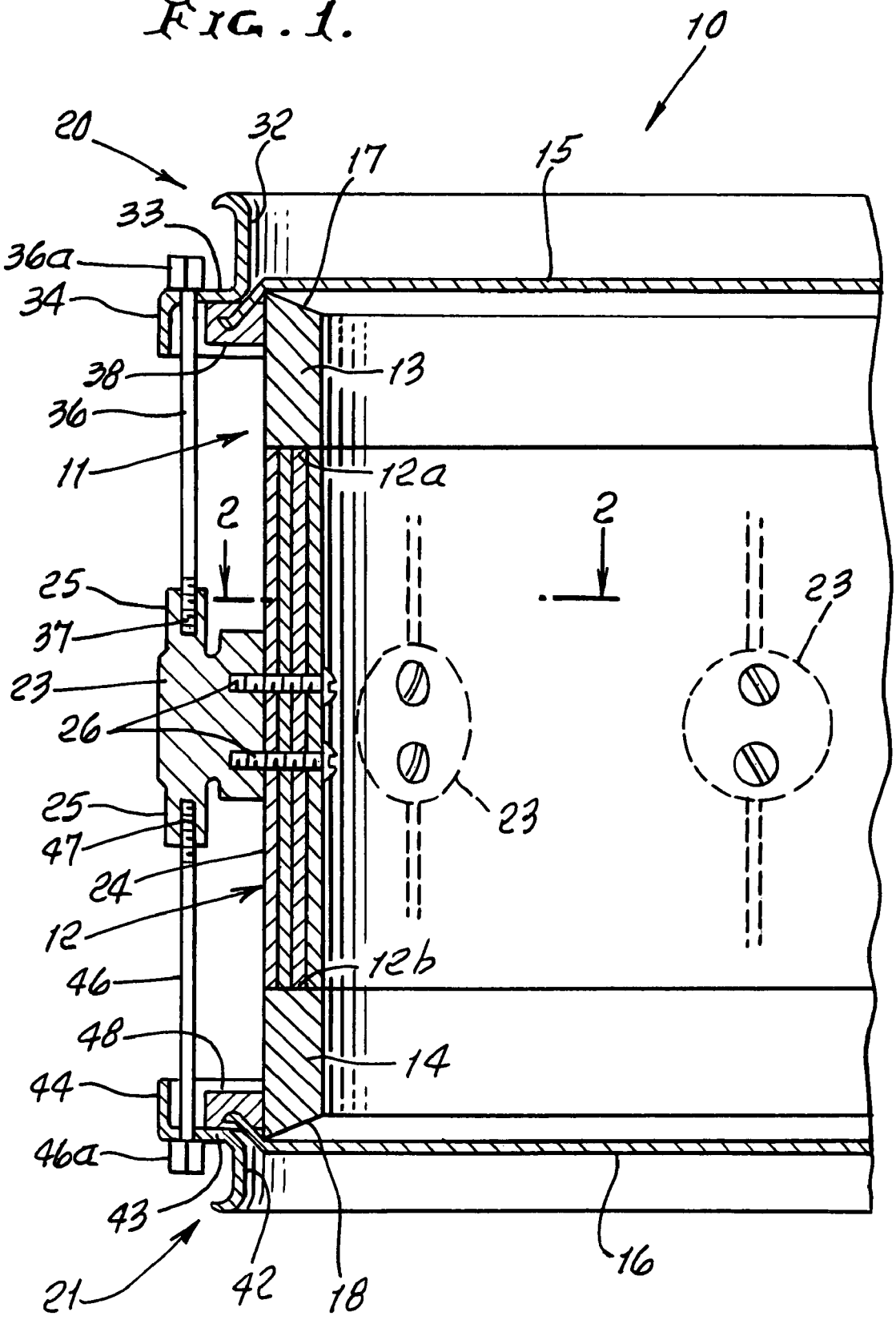
FIG. 1 is a vertical section taken through a drum assembly.

In FIGS. 1 and 2, a drum 10 has a metal shell 11 with a first wall section 12 consisting of wood, a second wall section 13 and a third wall section 14. The section 12 is preferably located between sections 13 and 14, so that drumheads 15 and 16 may stretch over annular beveled metallic edges 17 and 18 that do not "weather" or otherwise change with atmospheric or other conditions. Sections 13 and 14 may have interfit with section 12, as for example at end locations 12*a* and 12*b*. Also sections 13 and 14 may preferably and alternatively comprise axial extensions of section 12, so that only one section 12 made of wood is provided. See FIG. 1*a* showing wooden lamination end taper at 17*a*

Sections 12, 13 and 14 then each typically consist of radially overlapping wooden laminations, and section 12 and laminations 12*c* may extend to opposite end locations 17 and 18. The grain in radially successive laminations extends at alternate angles $+\alpha_1$, $-\alpha_2$, $+\alpha_1$, $-\alpha_2$, etc as later defined, for audio output tone control.

In the drum example shown, means is also provided for retaining the drumheads on the drum, including flanges at axial ends of the drum, retainers on one of the sections, and adjustable tensioning means interconnecting the flange means and retainer means. In the example, flange structure 20 is provided in association with metal section 13 of the shell, and flange structure 21 in association with metal section 14 of the shell. Retainer elements 23 are spaced about and adjacent the outer surface 24 of wooden section 12, mid-way between metal sections 13 and 14, and the elements 23 may have circular cross sections and consist of brass. See U.S. Pat. No. 6,525,250 incorporated herein by reference. The elements 23 carry tubular holders 25 projecting vertically and parallel to the drum axis, but in axially opposite directions. Tightening adjustment fasteners 26 project radially through the shell section 12 to affix the elements 23 to the outer surface of the section 12.

The upper flange structure 20 has an upwardly extending annular rim portion 32 extending above the level of drumhead 15, a medial annular flange portion 33 extending radially outwardly below the level of 32, for transmitting head tightening loading, and a lower annular portion 34 extending downwardly from the outer extent of 33. A tightening adjustment fastener or tensioner rod 36 extends downwardly through 33, and its lower end has external threads 37 that interfit rotatably internal threads in upper holder 25. Note fastener head 36*a* bearing on the upper surface of 33. The lower surface of 33 exerts downward loading onto a retention ring 38 to which drumhead 15 is suitably attached, for tightening (or loosening) same, by drawing the head over 17.

Likewise, lower flange structure 21 has a downwardly extending annular rim or flange portion 43 extending below the level of drumhead 16, a medial annular portion 44 extending radially outwardly above the level of 42 for transmitting head tightening loading, and an upper annular portion 44 extending upwardly from outer extent of 43. A tightening adjusting fastener or tensioner rod 46 extends upwardly through 42, and has external threads 47 that interfit rotatably the internal threads in lower holder 25. Note fastener head 46*a* bearing on the lower surface of 42. The upper surface of 43 exerts upward loading onto lower retention ring 48 to which drumhead 16 is suitably attached for tightening (or loosening) same, i.e. over bevel 18. Accordingly, the drumheads are individually adjustable.

Figure 4:
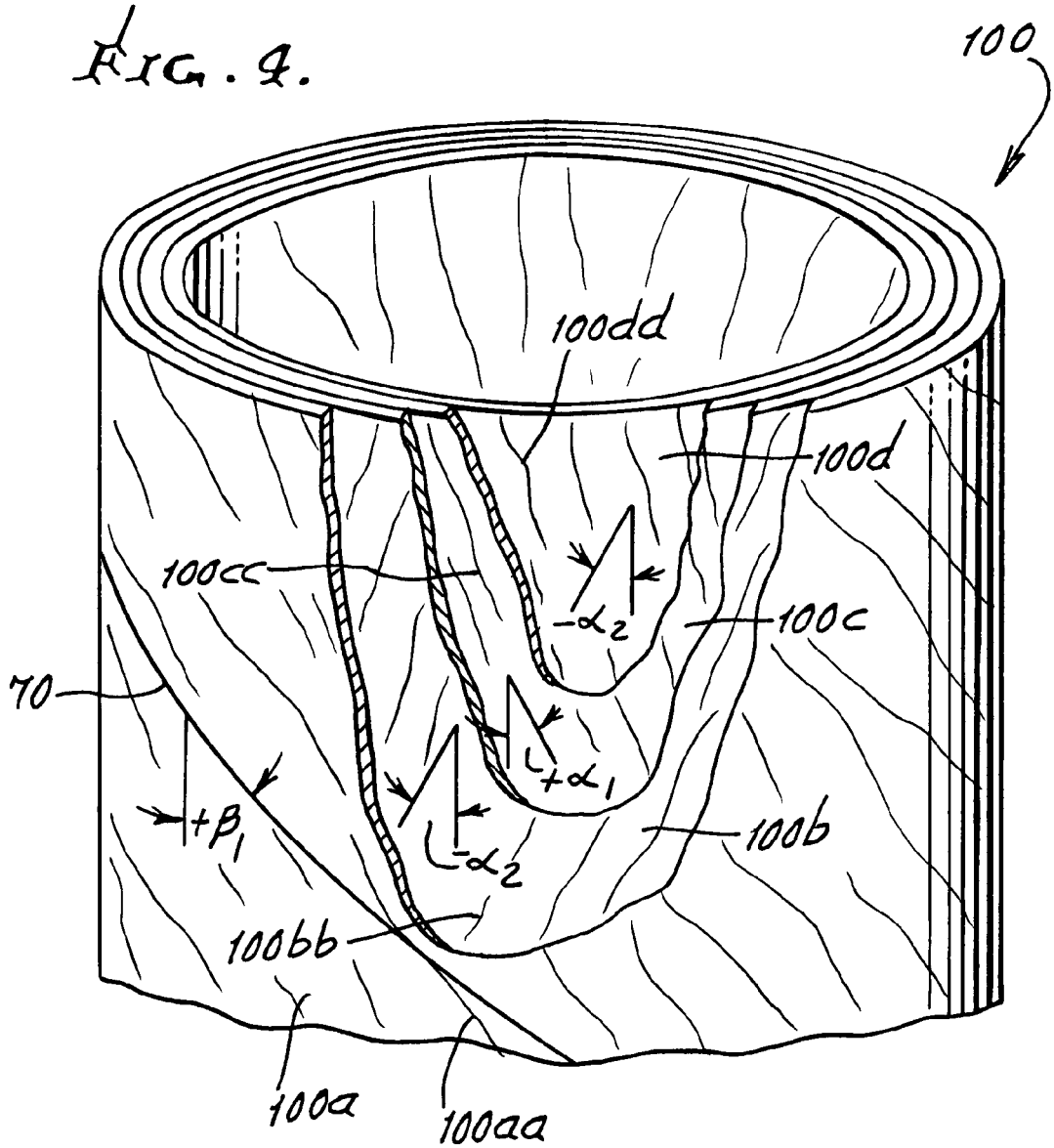
FIG. 4 is a perspective view of multiple plys or laminations for use in a drum, and broken away to show grain angularities of radially successive plys.
Figure 5:
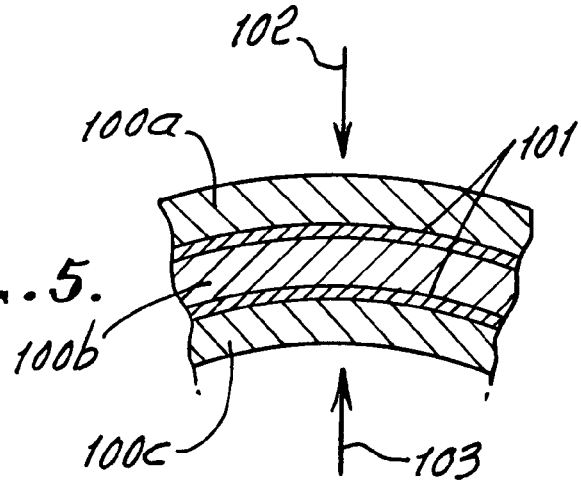
FIG. 5 is an enlarged fragmentary view showing bonding of successive plys.

FIG. 4 shows a shell or shell section 100 having multiple wooden curved plies or laminations 100*a*, 100*b*, 100*c* and 100*d*, in radial overlapping succession. Successive plies are typically bonded together as by adhesive shown at 101 in FIG. 5, under radial pressure exerted as shown by arrows 102 and 103. The plies may consist of oak, ash, or other suitable wood. Each ply is typically between ⅛ and ⅜ inches in thickness.

Each ply has grain extending in a characteristic direction, the grain of at least one ply extending crosswise relative to the grain direction of the next adjacent ply. See grain 100*aa*, 100*bb*, 100*cc*, and 100*dd*, directed as shown. Grain 100*aa* extends crosswise relative to grain 100*bb*, and 100*bb* is crosswise relative to 100*cc*, etc. The crosswise angularities are indicated at $+\alpha_i$ and $-\alpha_2$ in radial succession.

Typically the following angularities are provided for successive and alternate laminations $$30° < \alpha_1 < 60°$$

$$-30° < -\alpha_2 < -60°$$

and preferably $$+\alpha_1 \cong 45°$$

$$-\alpha_2 \cong -45°$$

and where more than two laminations are provided:

first lamination: $\alpha_1 \cong 45°$ second lamination: $-\alpha_2 \cong -45°$ third lamination: $\alpha_1 \cong 45°$ fourth lamination: $-\alpha_2 \cong -45°$ etc.

Preferably, each shell has between 2 and 8 laminations.

A second feature of the invention consists in that one ply defines a cut extending at an angle $+\beta_1$ relative to the drum axis, and the adjacent ply defines a cut extending at an angle $-\beta_1$ relative to the drum axis, said cuts extending between upper and lower edges of the plys. See for example cuts 70 and 71 in FIG. 3. Note that grain direction continuity is maintained; at or between opposite sides of the cuts. See for example in FIG. 3 direction of grains 100*aa* at the lower side of the cut 70 and the same direction of grain 100*aa* at the upper side of cut 70. The cut extends at angle $+\beta_1$ in ply 100*a*, at $-\beta_1$ in ply 100*b*, at angle $+\beta_1$ in ply 100*c*, $-\beta_1$ in ply 100*d*, etc.

The invention has been found or discovered to provide desirably and significantly enhanced and deeper sonority of drum audio output.

I claim:

1. In a drum shell, the combination comprising a) said shell having multiple wooden plys, b) each ply having grain extending in a characteristic direction, c) the grain direction of at least one ply extending crosswise relation to the grain direction of the next adjacent ply, about the shell, d) said one ply defining a cut extending at an angle $+\beta$ relative to the drum axis, and said adjacent ply defines a cut extending at an angle $-\beta$ relative to the drum axis, said cuts extending between upper and lower edges of the plys.

2. The combination of claim 1 wherein the grain direction of said one ply extends at an angle $+\alpha_1$ relative to the drum axis, and the grain direction of said next adjacent ply extends at an angle $-\alpha_2$ relative to the drum axis.

3. The combination of claim 2 wherein $30° < +\alpha_1 < 60°$ and $-30° < -\alpha_2 < -60°$.

4. The combination of claim 2 wherein $\alpha_1 \cong 45°$ and $-\alpha_2 \cong 45°$.

5. The combination of claim 1 wherein the grain direction of each ply extends crosswise relative to the grain direction of the next adjacent ply or plys.

6. The combination of claim 5 wherein each ply is adhesively bonded to the next adjacent ply.

7. The combination of claim 6 wherein there are between two and eight plies in the shell.

8. The combination of claim 1 wherein said plys are embodied in a first section of the shell, the shell having a second section endwise assembled to the first section.

9. The combination of claim 8 wherein the second section consists of one of the following:

i) a non-wooden material ii) metal.

10. The combination of claim 1 wherein said plies are embodied in a first section of the shell, the shell having second and third sections endwise assembled to opposite ends respectively of the first section.

11. The combination of claim 1 wherein said multiple wooden plys form tapers at opposite ends of the shell.

12. In a drum shell, the combination comprising a) said shell having multiple wooden plys, b) each ply having grain extending in a characteristic direction, c) the grain direction of at least one ply extending crosswise relation to the grain direction of the next adjacent ply, about the shell, e) and wherein said one ply defines a cut extending at an approximate angle $+\beta$ relative to the drum axis, and said adjacent ply defines a cut extending at an approximate angle $-\beta$ relative to the drum axis, said cuts extending between upper and lower edges of the plys, and wherein $+\alpha_1 \cong \alpha_2$ whereby grain directional continuity is maintained at opposite sides of the cuts.

13. The combination of claim 12 wherein said cuts through said multiple plys are substantially angularly equally spaced about an axis defined by the shell.

* * * * *